US010232380B2

(12) United States Patent
Knecht et al.

(10) Patent No.: US 10,232,380 B2
(45) Date of Patent: Mar. 19, 2019

(54) EXTRACTION MECHANISM FOR COMMINUTION DEVICE

(71) Applicants: David Udy, Layton, UT (US); FLSmidth A/S, Valby (DK)

(72) Inventors: Johann Knecht, Wadersloh (DE); David Udy, Layton, UT (US)

(73) Assignee: FLSmidth A/S (DK)

( * ) Notice: Subject to any disclaimer, the term of this patent is extended or adjusted under 35 U.S.C. 154(b) by 60 days.

(21) Appl. No.: 15/527,451

(22) PCT Filed: Jan. 13, 2016

(86) PCT No.: PCT/US2016/013213

§ 371 (c)(1),
(2) Date: May 17, 2017

(87) PCT Pub. No.: WO2016/115229

PCT Pub. Date: Jul. 21, 2016

(65) Prior Publication Data

US 2018/0326426 A1 Nov. 15, 2018

Related U.S. Application Data

(60) Provisional application No. 62/104,235, filed on Jan. 16, 2015.

(51) Int. Cl.
*B02C 23/04* (2006.01)
*E05C 9/04* (2006.01)
(Continued)

(52) U.S. Cl.
CPC ..... *B02C 23/04* (2013.01); *B02C 4/02* (2013.01); *B02C 4/28* (2013.01); *B02C 4/30* (2013.01);
(Continued)

(58) Field of Classification Search
CPC ..... E05C 9/041; H01R 29/00
(Continued)

(56) References Cited

U.S. PATENT DOCUMENTS 3,220,658 A * 11/1965 Shelton, Jr. ..... B02C 13/00 241/191
3,545,689 A 12/1970 Luscombe
(Continued)

FOREIGN PATENT DOCUMENTS

CN 103691510 4/2014
EP 2778328 A2 9/2014
(Continued)

OTHER PUBLICATIONS

The International Search Report and Written Opinion dated Mar. 11, 2016, 8 pages.

*Primary Examiner* — Edward T Tolan
*Assistant Examiner* — Mohammed S. Alawadi
(74) *Attorney, Agent, or Firm* — Jeffrey A. Sharp

(57) ABSTRACT

A comminution device can include a crushing body extraction mechanism. The crushing body extraction mechanism can be configured to permit one or more crushing bodies (e.g. rollers of a roller press, etc.) to be continuously moved linearly away from a frame to expose the crushing bodies from the frame. In some embodiments, the extraction mechanism may be configured to utilize one or more rack and pinion mechanisms. The pinion for each such mechanism may be powered by one or more rotary motors or other type of rotary drive mechanism. In other embodiments, the extraction mechanism can include one or more rack and ratchet mechanisms. Each rack and ratchet mechanism may include a hydraulic cylinder or other linear actuator that is extendable and retractable for actuating motion of a ratchet along a rack having columns of differently angled steps to
(Continued)

facilitate extension and retraction of one or more crushing bodies.

3 Claims, 12 Drawing Sheets

(51) Int. Cl.

| | |
|---|---|
| ***B02C 4/30*** | (2006.01) |
| ***B02C 4/32*** | (2006.01) |
| ***B02C 23/08*** | (2006.01) |
| ***B02C 4/02*** | (2006.01) |
| ***B02C 13/31*** | (2006.01) |
| ***B02C 4/28*** | (2006.01) |
| ***B02C 23/00*** | (2006.01) |
| ***B02C 13/282*** | (2006.01) |

(52) U.S. Cl.
CPC ..... *B02C 4/32* (2013.01); *B02C 13/31* (2013.01); *B02C 23/00* (2013.01); *B02C 23/08* (2013.01); *E05C 9/041* (2013.01); *B02C 13/282* (2013.01)

(58) Field of Classification Search
USPC ..... 241/27, 285.3; 198/626.1
See application file for complete search history.

(56) References Cited

U.S. PATENT DOCUMENTS

| | | | | |
|---|---|---|---|---|
| 3,881,663 | A | 5/1975 | Brown | |
| 3,970,256 | A * | 7/1976 | Ruegger | B02C 4/28 241/231 |
| 4,049,206 | A * | 9/1977 | Konig | B02C 13/095 241/189.2 |
| 4,919,039 | A * | 4/1990 | Nutter | F15B 15/061 74/578 |
| 6,306,007 | B1 * | 10/2001 | Mori | B21B 28/04 451/5 |
| 6,478,345 | B1 * | 11/2002 | Viney | E05C 9/041 292/39 |
| 7,828,025 | B2 * | 11/2010 | McBride | B27L 11/02 144/162.1 |
| 8,973,856 | B2 * | 3/2015 | Croyle | B02C 4/28 241/285.2 |
| 2005/0252335 | A1 * | 11/2005 | Moody | E05B 15/0046 74/578 |
| 2007/0001043 | A1 * | 1/2007 | Moriya | B02C 13/095 241/189.1 |
| 2011/0036936 | A1 | 2/2011 | Herrera | |

FOREIGN PATENT DOCUMENTS

| | | | | |
|---|---|---|---|---|
| GB | 2257745 | A * | 7/1991 | E05C 9/041 |
| WO | WO2005046977 | A1 * | 12/2003 | B30B 9/321 |

* cited by examiner

EXTRACTION MECHANISM FOR COMMINUTION DEVICE

FIELD OF THE INVENTION

The present innovation related to devices configured to comminute material (e.g. ore, minerals, rock, etc.) and mechanisms used to move crushing bodies of a comminution device for facilitation of maintenance of the comminution device and/or crushing bodies of the comminution device.

BACKGROUND TO THE INVENTION

Examples of comminution devices and mechanisms that may be used in such devices may be appreciated from U.S. Pat. Nos. 880,035, 4,484,879, 4,838,156, 4,905,910, 5,192,030, 5,211,108 5,354,002, 5,405,091, 5,454,520, 5,505,389, 5,601,242, 5,918,823 and U.S. Patent Application Publication Nos. 2009/0314868 and 2009/0236455. In some types of comminution devices, the crushing bodies of the devices may require the most time and cost to an operator for purposes of performing maintenance. For instance, the performance of maintenance on rollers of a roller press can often be labor intensive and require substantial amounts of time (e.g. 1-3 days). As a result, roller replacement can contribute to a major part of the downtime for a roller press (e.g. the time in which a roller press is not running to comminute material).

SUMMARY OF INVENTION

A device is provided that is configured to comminute material. The device can include a frame, a housing that is positionable within the frame, at least one crushing body connected to the housing, and a crushing body extraction mechanism connected to at least one of the housing and the frame. The extraction mechanism can be configured to linearly and continuously move the housing and/or the at least one crushing body relative to the frame from a first position located within the frame to a second position that is at least partially positioned out of the frame. The extraction mechanism can also be configured to linearly move the housing and at least one crushing body from the second position to the first position. Embodiments of the extraction mechanism of the device and methods of using the device and methods of providing and/or using the extraction mechanism are also provided herein.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of devices configured for the comminution of material that utilize a crushing body extraction mechanism and methods of making the same are shown in the accompanying drawings. It should be understood that like reference numbers used in the drawings may identify like components.

DETAILED DESCRIPTION OF THE DRAWINGS

Figure 1:
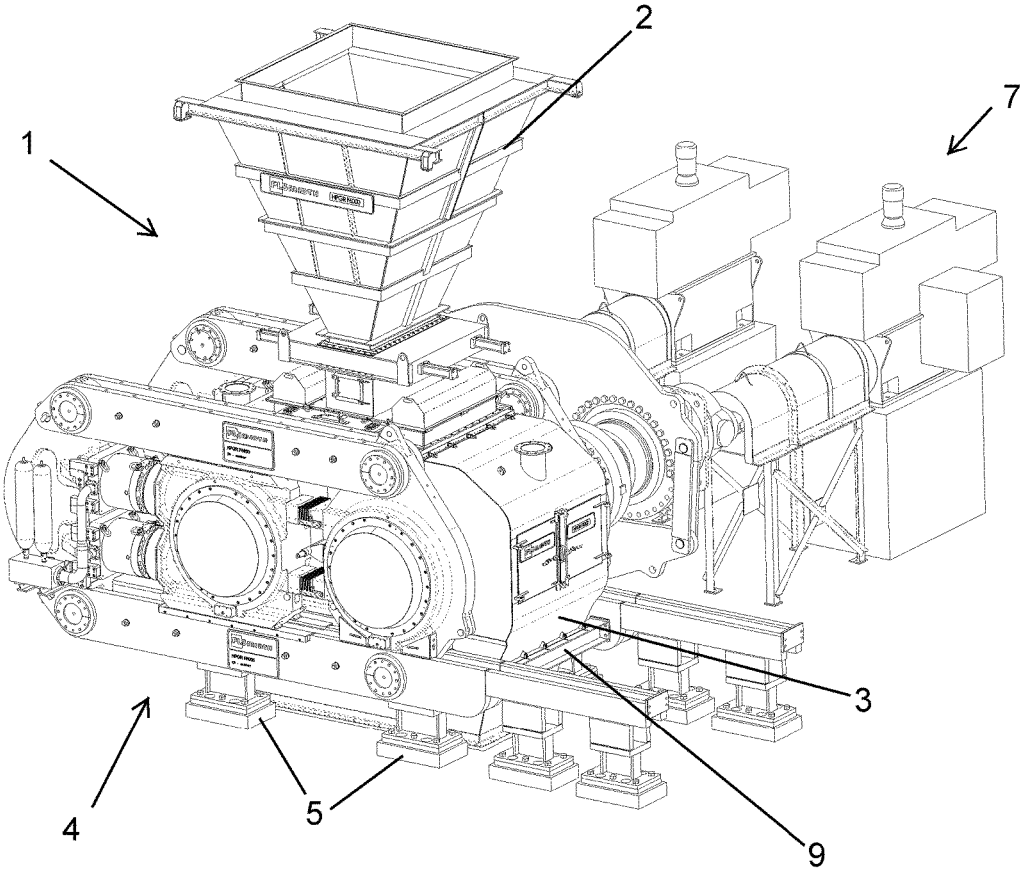
FIG. 1 is a perspective view of a first exemplary embodiment of the device configured to comminute material.

Referring to FIG. 1, a device 1 that is configured to comminute material can include a feed conduit 2 that is connected to a frame 4 of the device so that material can be fed into the device 1 for comminution. The frame 4 can be configured to include walls, a floor, a ceiling, or other structure that is attached to the frame 4 or defined by the frame 4 to enclose or at least partially enclose crushing bodies 6 to prevent extraction of dust and prevent access to moving parts of the device 1. For example, the enclosing structure of the frame can prevent extraction of dust from the frame 4 when the device 1 is operated to comminute material and can prevent access to the moving parts of the device 1 for the safety of personnel that may operate or monitor the device 1 during use of the device 1.

The material to be fed into the device 1 via the feed conduit 2 can be rock, ore, mineral, or other type of material. In some embodiments, the device 1 can be configured as a roller press and the crushing bodies 6 can be configured as rollers. In other embodiments, it is contemplated that the device could be configured as type of mill or other type of comminution device.

For instance, the device 1 can include a plurality of crushing bodies 6 within a crushing body module 3. The crushing body module 3 can include a housing 9 to which one or more crushing bodies 6 are attached so that the housing 9 and crushing bodies 6 can be moved relative to the frame 4 from a first position 21 located within the frame where the crushing bodies are enclosed by the frame 4 to a second position 22 that positions the one or more crushing bodies 6 so that they are at least partially out of the frame 4 (e.g. not fully enclosed by the frame 4, entirely out of the frame 4, or entirely unenclosed by the frame 4). For example, the housing 9 can include bearing blocks connected to the bearings of the roller shafts to which crushing bodies 6 are connected to connect the crushing bodies 6 to the frame 4 so that the housing 9 and crushing bodies 6 are moveable relative to the frame between the first and second positions 21 and 22.

At least one crushing body drive mechanism 7 can be coupled or otherwise connected to the crushing bodies to rotate the crushing bodies or otherwise move the crushing bodies to comminute material. For example, the crushing bodies 6 can be configured to rotate or otherwise move to crush material. Material from the feed conduit 2 can be fed into a gap 6*a,* or nip, defined between spaced apart crushing bodies. Rotation of the crushing bodies can comminute the material as it passes through this nip. In some embodiments, at least one of the crushing bodies may be moveable relative to the other crushing body within the housing 9 to adjust the size of the gap 6*a*. The device 1 can also have an output conduit or outlet for outputting the material crushed or otherwise comminuted by the crushing bodies.

The frame 4 of the device 1 can include a plurality of legs 5 that are positioned to support the frame on a surface or structure, such as a floor. One or more rotational driving mechanisms can be coupled to each crushing body to drive rotation of the crushing body for comminution of material fed to the device. The frame can also include a plurality of rails 8 that are supported by the legs 5.

The device 1 can also be configured to include a crushing body extraction mechanism 11. For example, any of the first, second, third, or fourth exemplary crushing body extraction mechanisms 11 shown in FIGS. 2-11 can be included in the device 1. In yet other embodiments, other types of crushing body extraction mechanisms 11 may be utilized.

Figure 2:
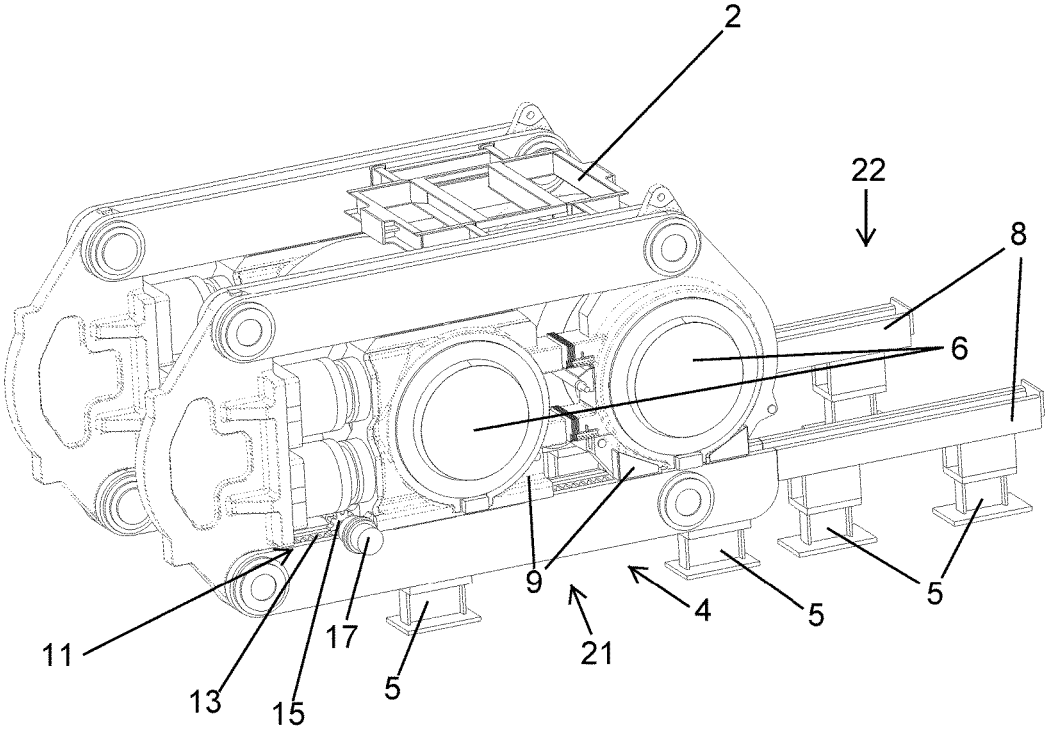
FIG. 2 is a perspective view of a first exemplary crushing body extraction mechanism that is utilizable for moving a housing and multiple crushing bodies into and out of the frame of the device in the first exemplary embodiment of the device configured to comminute material
Figure 3:
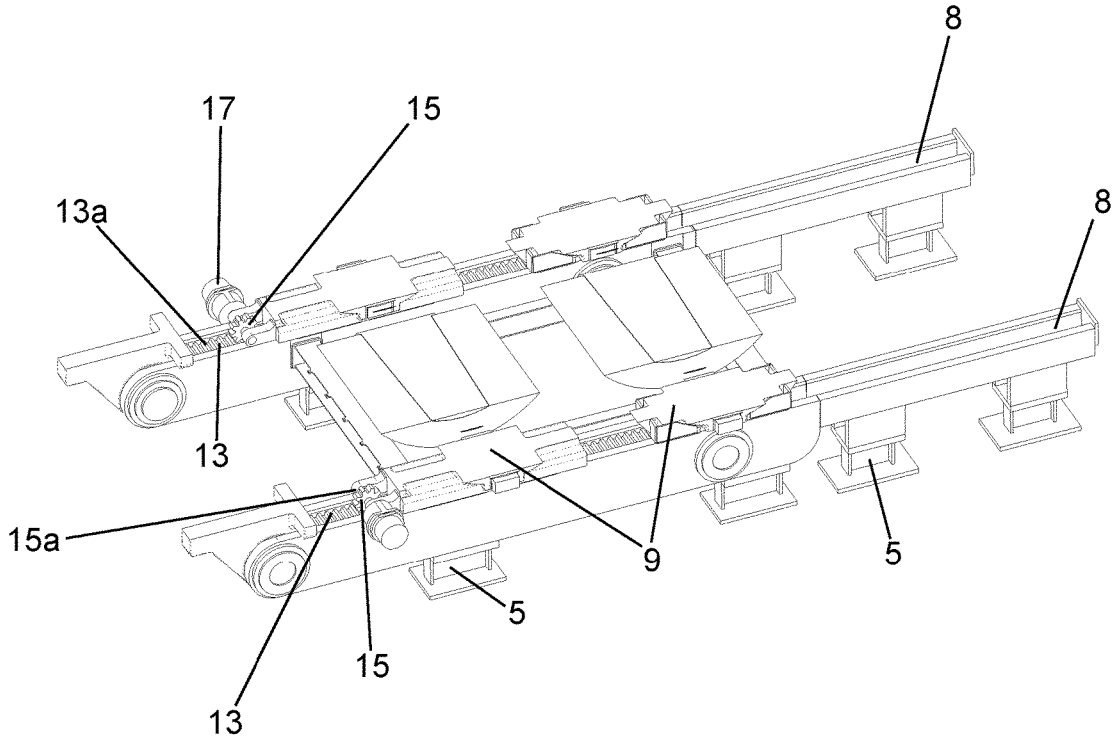
FIG. 3 is a cross sectional view of the first exemplary crushing body extraction mechanism shown in FIG. 2 to illustrate components of the extraction mechanism.
Figure 4:
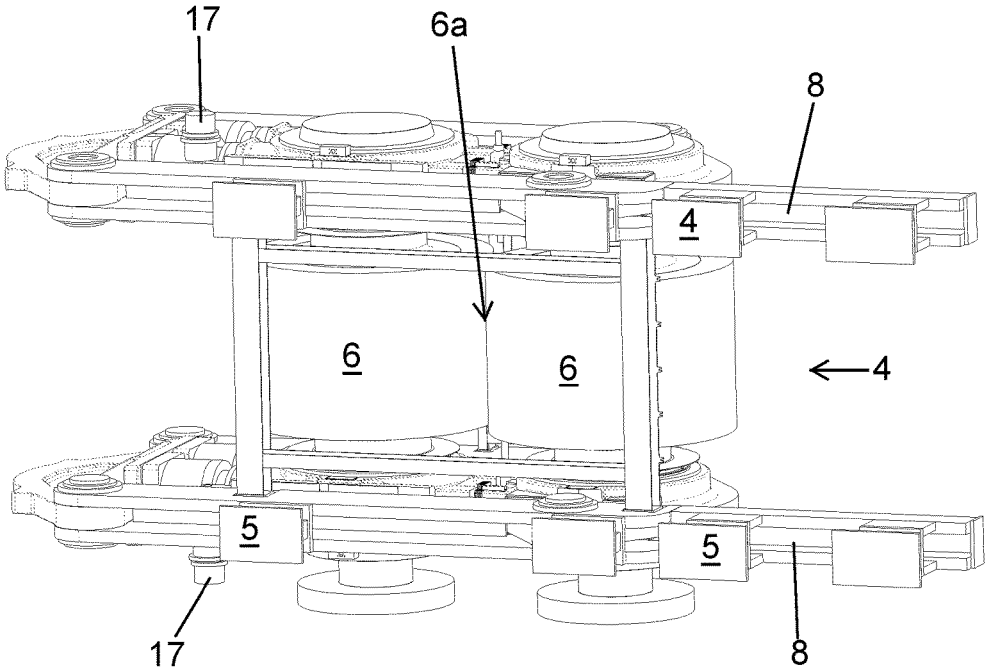
FIG. 4 is a bottom view of the first exemplary crushing body extraction mechanism.

Referring to FIGS. 2-4, the crushing body extraction mechanism 11 can be configured to move the crushing body module 3 into and out of the frame 4 so that the crushing bodies 6 can be accessed for maintenance such as repair or replacement. The crushing body extraction mechanism can be configured to linearly move the crushing bodies 6 and/or housing 9 to which those crushing bodies are connected relative to the frame 4 continuously along a linear path of travel from a first position 21 in which the crushing bodies 6 and housing 9 are positioned in the frame for comminution operations to a second position 22 in which the crushing bodies 6 and housing 9 are moved at least partially out of the frame. In some embodiments, the second position 22 may be defined to locate the crushing bodies 6 entirely out of the frame 4 along rails 8 of the frame 4 so that the crushing bodies 6 can be positioned on the rails 8 of the frame 4 in a position that is considered out of the frame of the device 1. When located out of the frame of the device, the crushing bodies 6 are positioned so that the nip (e.g. gap 6*a*) between the crushing bodies is located substantial away from the feed conduit and out of alignment of the feed conduit so that material fed into the feed conduit does not pass into the nip or through the nip. The movement of the crushing bodies 6 and/or housing 9 from the first position to the second position can be configured to move these elements away from the feed conduit 2 so that the crushing bodies are easily accessed by personnel for the performance of maintenance operations (e.g. repair or replacement of crushing bodies 6, etc.).

The extraction mechanism embodiment of FIGS. 2-4 can include racks 13 attached to different rails of the frame 4. For instance two or more rails 8 of the frame can be positioned at a lower portion of a frame to have such racks 13. In other embodiments, upper rails or additional lower rails can also include such racks as components of an extraction mechanism 11. Each of the racks 13 can be positioned so that they are stationary, or affixed, to a respective rail 8 of the frame 4. For instance, in some embodiments, each of the racks 13 can each be positioned within a channel, slot, groove, or other type of aperture defined by a respective rail 8 of the frame 4. In yet other embodiments, it is contemplated that the racks 13 can each be positioned on or in a respective rail 8, beam, other type of member, or other type of component of the frame 4 for engagement with the pinions 15.

Pinions 15 can be attached to the housing 9 so that each pinion 15 is positioned for contacting or otherwise engaging a respective one of the racks 13. The pinions 15 may be, for example, gears or other rotatable elements having projections or teeth that are configured to mate with steps or grooves defined in the rack 13 as the pinion is rotated to move along the length L of the rack 13. Each step or groove of the rack 13 may extend along a width W of the rack in a direction that is perpendicular or substantially perpendicular to the length of the rack 13.

Each of the pinions 15 may be configured to rotate in a first rotational direction (e.g. clockwise) for moving along the length of a rack 13 about the steps 13*a* or grooves 13*d* of the rack in a first longitudinal direction along the rack (e.g. along the length of the rack from a first end of the rack to a second opposite end of the rack). Each of the pinions 15 can also be configured to rotate in a second rotational direction (e.g. counter clockwise) that is opposite its first rotational direction for moving along the length of the rack 13 about the steps 13*a* or grooves 13*d* of the rack in a second longitudinal direction that is opposite the first longitudinal direction (e.g. along the length of the rack from the second end of the rack to the first end of the rack). During motion of the pinion 15 along the rack 13, the teeth 15*a* or other type of projections of the pinion 15 that extend from a perimeter surface (e.g. a circumferential surface, an upper surface, etc.), or other surface of the pinion can contact or otherwise engage steps 13*a* as they pass into and out of grooves 13*d* defined between the steps 13*a*. The motion of the pinions 15 can cause the module 3, such as the housing 9 and crushing bodies 6 attached thereto, relative to the frame from the first position 21 to the second position 22.

Each of the pinions 15 can be connected to at least one drive mechanism 17. In some embodiments, each pinion can be attached to a respective drive mechanism 17 of a plurality of drive mechanisms. For instance, each drive mechanism 17 may be connected to a respective one of the pinions 15 to drive rotation of that pinion 15 so that each rotated pinion 15 moves along the steps 13*a* of the rack to which that pinion 15 is engaged. In other embodiments, it is contemplated that one drive mechanism 17 may be connected to multiple pinions 15 for controlling motion of all the pinions 15 or a group of the pinions 15.

Each drive mechanism 17 can be a rotary drive mechanism that can be configured to drive rotation of at least one pinion 15 in different rotational directions. For example, in some embodiments each drive mechanism 17 may be an electric rotary motor or a hydraulic rotary motor having a gear assembly coupled to at least one pinion 15.

In some embodiments, a controller (e.g. a computer device having a processor connected to non-transitory memory for running at least one application stored in the memory and at least one transceiver for communicating with other elements) can be communicatively connected to the drive mechanisms 17 to control the speed of rotation and direction of rotation at which the drive mechanisms 17 rotate the pinions. The controller may have a wired communication connection to each drive mechanism 17 or a wireless communication connection to each drive mechanism 17.

The rotation of the pinions 15 driven by the drive mechanisms 17 can be configured so that rotation of pinions in a first rotational direction causes motion of the pinions 15 along the racks 13 in a first longitudinal direction to linearly move the crushing body module 3 (e.g. housing 9 and crushing bodies 6 connected thereto) from a first position 21 to a second position 22 continuously along their path of travel defined by the racks 13 (e.g. there is no stopping to accommodate repeated strokes of a hydraulic cylinder, e.g. there is no stopping and starting of motion of the module 3 as the pinions 15 are continuously rotated to linearly move the housing 9 and crushing bodies 6 from the first position 21 within the frame 4 to the second position 22 outside of the frame 4, etc.). Additionally, the rotation of the pinions 15 driven by the drive mechanisms 17 can be configured so that rotation of pinions in a second rotational direction opposite the first rotational direction causes motion of the pinions 15 along the racks 13 in a second longitudinal direction that is opposite the first longitudinal direction to linearly move the crushing body module 3 (e.g. housing 9 and crushing bodies 6 connected thereto) from the second position 22 to the first position 21 continuously along their path of travel defined by the racks 13.

Figure 5:
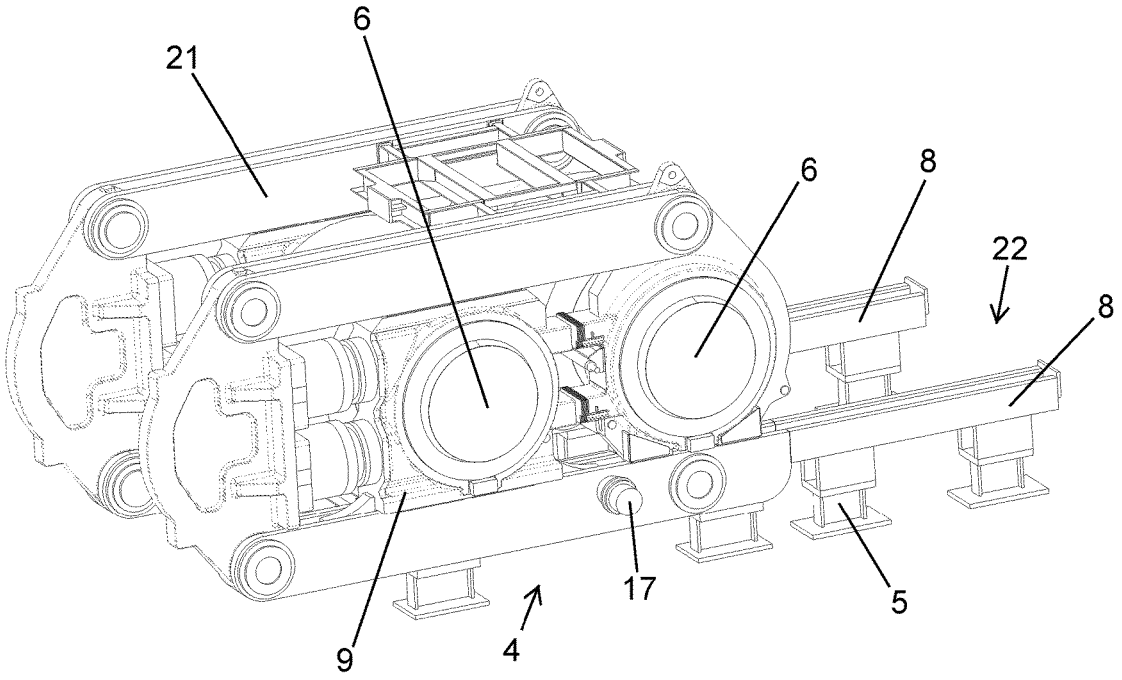
FIG. 5 is a perspective view of a second exemplary crushing body extraction mechanism that is utilizable for moving a housing and multiple crushing bodies into and out of the frame of the device in the first exemplary embodiment of the device configured to comminute material.
Figure 6:
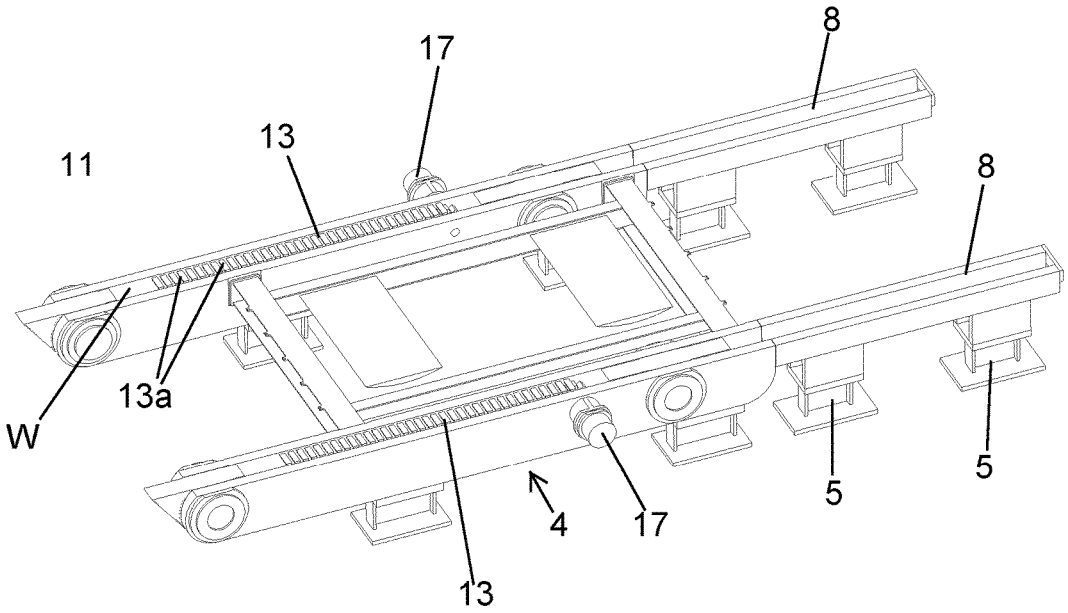
FIG. 6 is a cross sectional view of the second exemplary crushing body extraction mechanism shown in FIG. 5 to illustrate components of the extraction mechanism.
Figure 7:
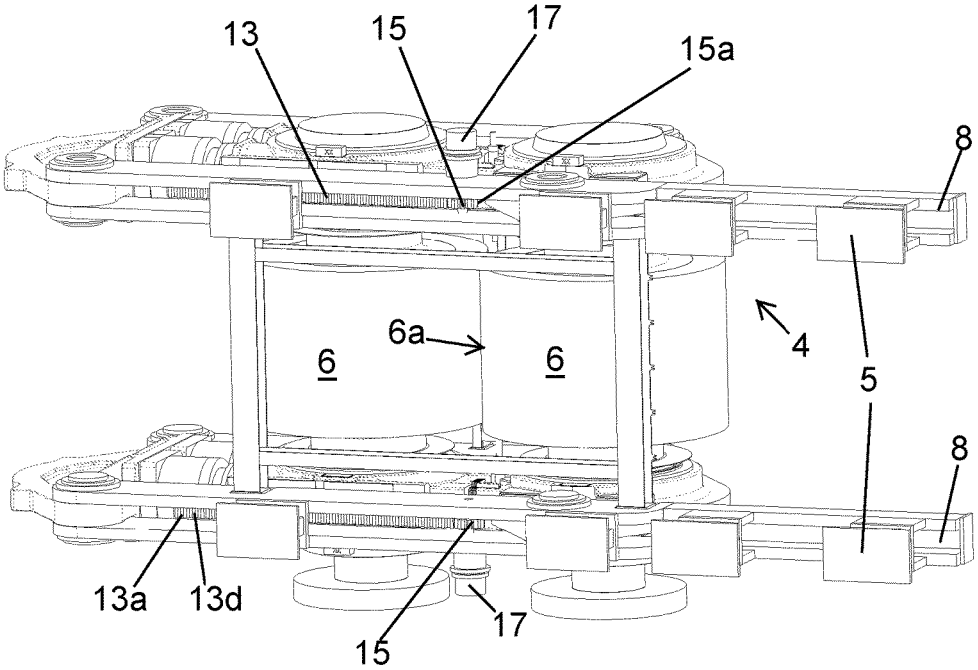
FIG. 7 is a bottom view of the second exemplary crushing body extraction mechanism.

Referring to FIGS. 5-7, embodiments of the extraction mechanism 11 can also be configured so that the racks 13 are attached to the housing 9 and so that the pinions 15 are connected to the frame 4. The drive mechanisms 17 connected to the pinions 15 can also be connected to the frame 4. The pinions 15 may be connected so that the position of the pinions does not change even though the pinions may be rotated by the drive mechanisms. The racks 13 can be connected to the housing 9 so that they are positioned within an opening or channel defined by a rail 8 of the frame 4.

In other embodiments, it is contemplated that the racks 13 can be positioned above a rail 8 or other structure of the frame 4 or may be positioned below a rail 8 or other component of a frame 4. For instance, each rack 13 can be connected to the housing 9 to be positioned for movement relative to the frame 4 where the rack 13 is position above a component of the frame 4, below the component of the frame 4, or within an aperture defined by some element of the frame (e.g. a slot within an elongated beam of the frame, a groove within a member of the frame, etc.). In yet other embodiments, the racks 13 can be positioned adjacent to a component of the frame via the racks' attachment to the housing 9 so that the racks 13 and housing 9 are moveable relative to the frame 4 for facilitating motion between the first and second positions 21 and 22. In yet other embodiments, it is contemplated that the connection of each rack 13 to the housing 9 for movement of the module 3 relative to the frame 4 can position that rack 13 adjacent to at least one component of the frame 4 (e.g. a rail, a beam, or other type of member) to engage with a pinion 15 in any of a number of other arrangements.

Each of the pinions 15 can be attached to a drive mechanism 17 for positioning within the channel defined in a respective rail 8 of the frame 4 to contact a respective one of the racks 13 or otherwise engage the steps 13*a* of that rack so that each of the racks 13 is moveable within a respective rail 8 of the frame to cause a linear continuous motion of the module 3 from the first position 21 to the second position 22 and vice versa via pinion rotation.

Each drive mechanism 17 can be connected to a respective rail 8 of the frame for connection to a respective one of the pinions 15. The drive mechanisms 17 can be actuated to drive rotation of the pinions 15 in a first rotational direction and a second rotational direction that is opposite the first rotational direction. The rotation of the pinions can cause the teeth 15*a* of the pinions 15 to contact or otherwise engage steps 13*a* of the rack to drive motion of the rack. When each pinion 15 is rotated in a first rotational direction, the pinion can engage the steps of the rack to cause the rack to move in a first direction to drive motion of the housing 9 and crushing bodies 6 from first position 21 to second position 22. Rotation of the pinion 15 in the second rotational direction can cause the rack 13 to travel in a second direction to move the housing and crushing bodies from the second position 22 to the first position 21.

The length L of the racks 13 having the steps 13*a* and grooves 13*d* can define the extent of the path of travel along which the housing 9 and crushing bodies 6 are moveable along the rails 8 of the frame 4. When the module 3 (e.g. housing 9 and crushing bodies 6) are moved to the second position, the pinion 15 may be located at a first end or adjacent a first end of the rack 13. When the module 3 is moved to the first position, the pinion 15 may be located at a second end of the rack 13 that is opposite the first end or adjacent the second end of the rack 13.

Figure 8:
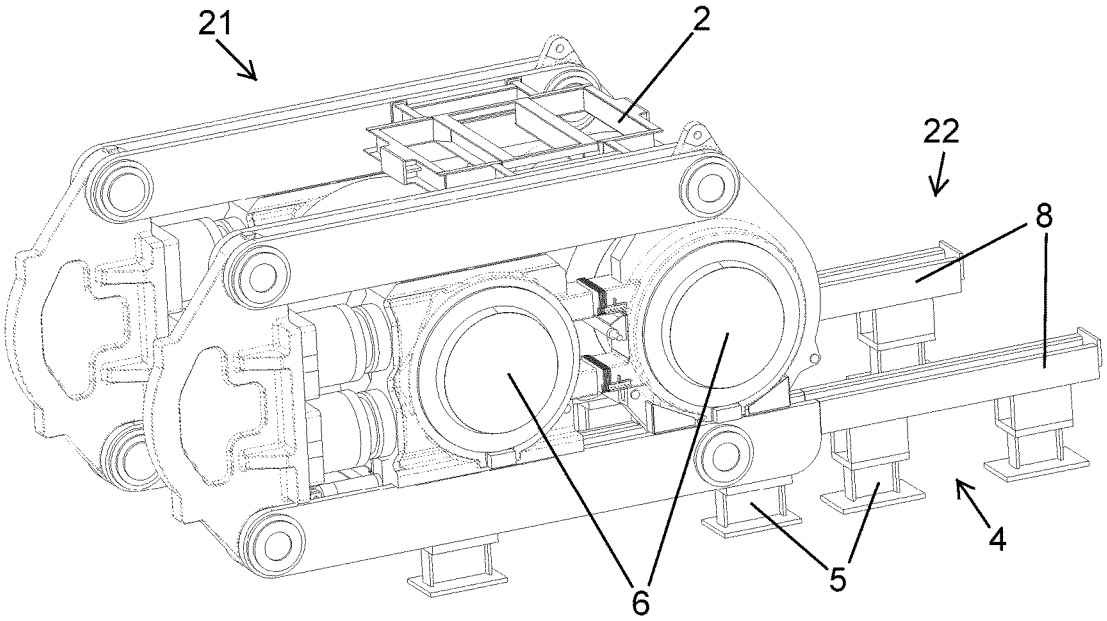
FIG. 8 is a perspective view of a third exemplary crushing body extraction mechanism that is utilizable for moving a housing and multiple crushing bodies into and out of the frame of the device in the first exemplary embodiment of the device configured to comminute material.
Figure 9:
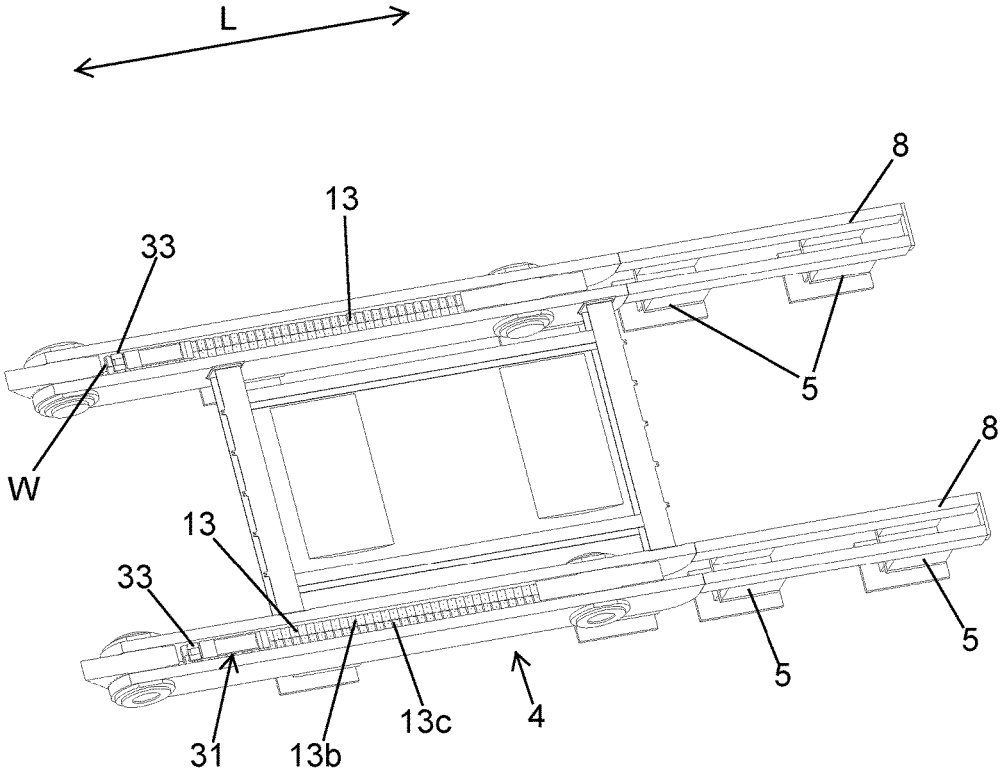
FIG. 9 is a cross sectional view of the third exemplary crushing body extraction mechanism shown in FIG. 8.
Figure 10:
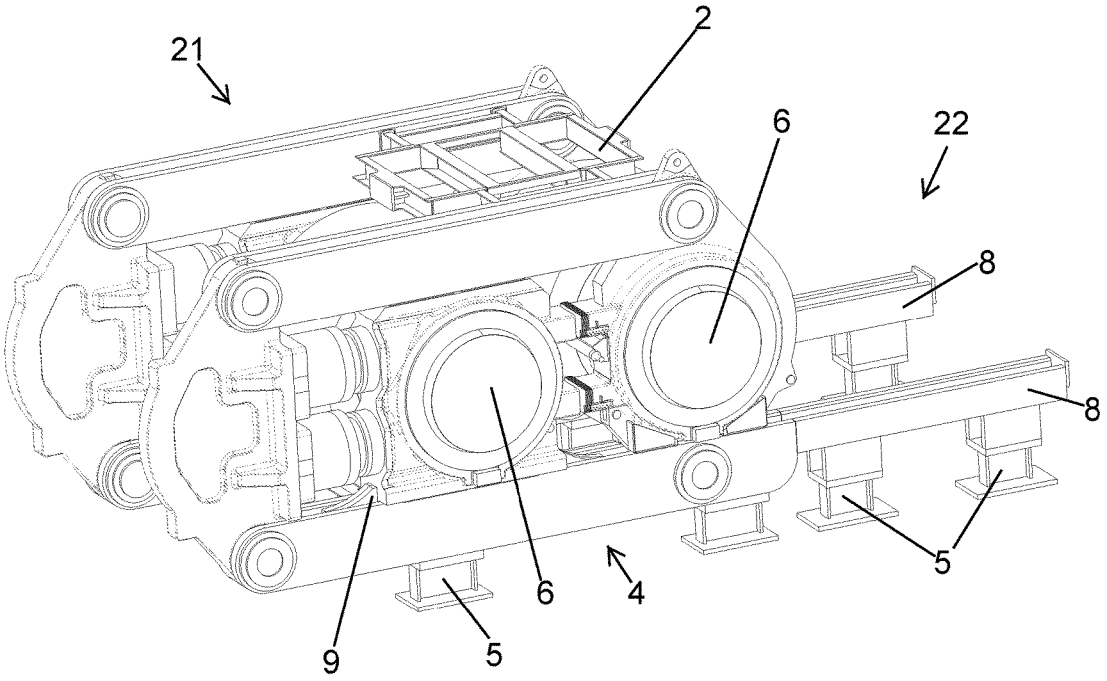
FIG. 10 is a perspective view of a fourth exemplary crushing body extraction mechanism that is utilizable for moving a housing and multiple crushing bodies into and out of the frame of the device in the first exemplary embodiment of the device configured to comminute material.
Figure 11:
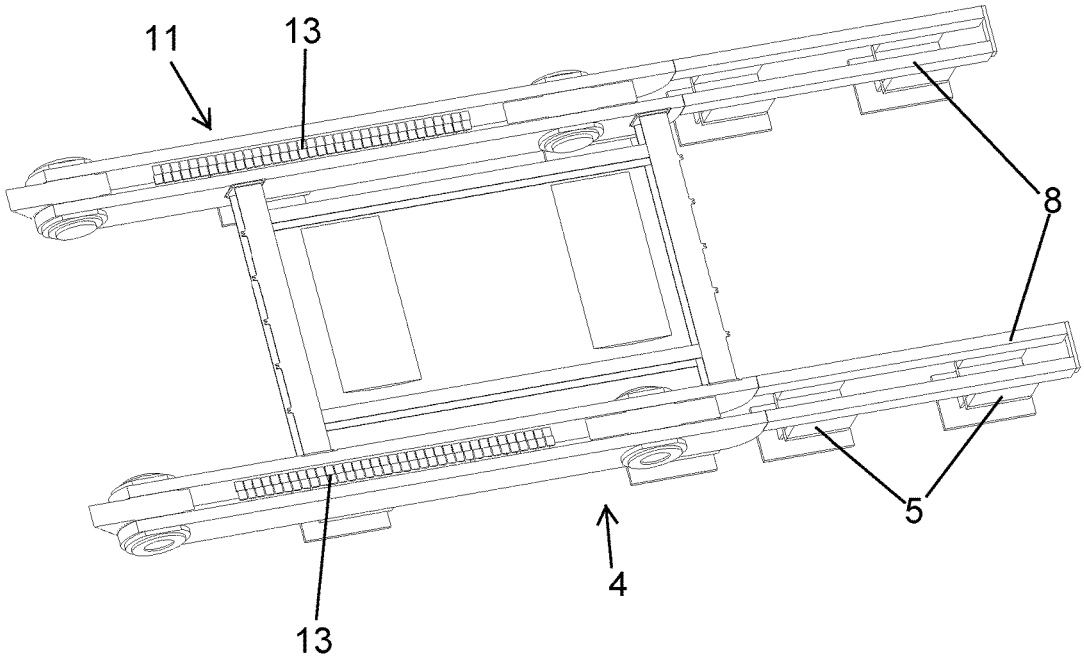
FIG. 11 is a cross-sectional view of the fourth exemplary crushing body extraction mechanism shown in FIG. 10.

Referring to FIGS. 8-9, another embodiment of the extraction mechanism 11 that can be included in embodiments of the device 1 includes a frame rack and ratchet arrangement. For this embodiment, each drive mechanism 31 can be connected to a respective ratchet 33 to drive motion of that ratchet along steps 13*a* defined in a respective rack 13. The drive mechanisms 31 can be connected to the housing 9 of the module 3 to which the crushing bodies 6 are attached so that the housing 9 and crushing bodies 6 of the module are moveable relative to the frame via movement of the ratchets 33 along the length L of the racks 13 attached to the frame 4.

Each drive mechanism 31 may be connected to the housing 9 via a moveable connection for connecting drive mechanisms 31 to the housing 9 can include a lateral moving mechanism of such a connection mechanism that facilitates motion of the drive mechanism 31 along the width W of a respective rack 13 to which it is adjacent. The lateral moving mechanism of this connection can be any type of mechanism, such as a slider mechanism, a pushing and pulling mechanism, an extendable and retractable mechanism (e.g. a hydraulic cylinder, a gas cylinder, etc.), or other type of positioning mechanism that is configured to laterally move at least one drive mechanism 31 from its extending position to its retracting position and vice versa. The moveable connection mechanism can also include a locking device for locking a position of the driving mechanism 31 in its extending position or in its retracting position.

Ratchets 33 can each be connected to a respective drive mechanism 31 so that the ratchet is contactable with or otherwise engageable with steps 13*a* of a respective rack 13 that is attached to a rail or other structure of the frame 4. In some embodiments, the racks 13 can each be positioned within a channel, slot, groove, or other type of aperture defined by a rail of the frame 4. Each ratchet can be connected to the housing so that it is also positioned in that channel, slot, groove, or other type of aperture for engagement with that rack 13. In yet other embodiments, it is contemplated that the racks 13 can each be positioned on a rail 8, beam, other type of member, or other type of component of the frame 4 for engagement with the ratchets 33.

Each drive mechanism 31 can be a linearly extendable and retractable drive mechanism such as a hydraulic cylinder that has a body and a leg that is connected to the body so that the leg is extendable and retractable. An end of the extendable and retractable leg can be attached to the ratchet 33 so that extension of the leg causes the ratchet 33 to move along the length L of the rack 13 and retraction of the leg also causes the ratchet 33 to move along the length L of the rack 13. Each ratchet 33 can include a projection for contacting with the steps of a respective rack for engaging that rack to facilitate travel of the module 3 from its first position 21 to its second position 22 and vice versa.

Each rack 13 can be configured to define multiple columns of steps, such as a first column 13*b* of steps and a second column 13*c* of steps. The first column 13*b* of steps can extend along the rack so that the first column of steps 13*b* is parallel to the second column 13*c* of steps. Each column of steps may have a plurality of spaced apart steps 13*a*. Gaps 13*d* may be defined between immediately adjacent steps 13*a* in each column of the steps. The gaps formed in the first column 13*b* of steps can be in alignment with the gaps of the second column of steps to facilitate a sliding or other linear motion of the ratchet 33*a* along the width W of the rack 13 for moveable positioning of the ratchet 33 for linear travel between the different columns of steps.

The first column 13*b* of steps can be angled or otherwise configured to facilitate motion of the ratchet in a first longitudinal direction along the length L of the rack from a first end of the rack to a second end of the rack. The second column 13*c* of steps can be angled or otherwise configured to facilitate motion of the ratchet in a second longitudinal direction along the length L of the rack 13 from the second end of the rack to the first end of the rack.

As mentioned above and as can be appreciated from other information included herein, each drive mechanism 31 can be moveably connected to the housing 9 for linear motion about the width W of the respective rack 13 to which it is aligned. Movement of the drive mechanism 31 can cause the ratchet 33 connected to the drive mechanism 31 to move along the width W of that rack 13 from the first column 13*b* of steps to the second column 13*c* of steps and vice versa.

During movement of the module 3 from the first position 21 to the second position 22, each drive mechanism 31 may be actuated to extend its leg to continuously linearly move the ratchet connected thereto in a first longitudinal direction along the length L of the first column 13*b* of steps from a position adjacent the first end of the rack 13 to a position adjacent the second end of the rack. The leg of the drive mechanism 31 can move along the length L of the rack adjacent to the first column 13*b* of steps as it continuously and linearly extends from the body of the drive mechanism (e.g. by moving above or below the steps of the first column 13*b*) to cause the ratchet to move along the steps of this column of steps from a position adjacent the first end of the rack to a position adjacent a second end of the rack that is opposite its first end. The extent to which the leg of the drive mechanism linearly extends from its retracted most position to its extended most position can define the distance of travel by which the module moves from the first position 21 to the second position 22 and vice versa.

To return the module 3 to the first position 21, each drive mechanism 31 can be moved from its extending position to a retracting position by being moved via its moveable connection to the housing 9 along the width of its respective rack 13 to be in alignment with the second column 13*c* of steps of that rack 13. This movement of each drive mechanism 31 along the width W of its respective rack can also cause the ratchet connected thereto to move along the width W to be in the second column 13*c* of steps via the aligned gaps 13*d* of the first and second columns of steps. Thereafter, each drive mechanism 31 can be actuated to retract the leg to drive motion of the ratchet 33 along the second column 13*c* of steps in a second longitudinal direction along the length L of the rack 13 continuously from adjacent the second end of the rack to adjacent the first end of the rack. The retracting leg may move adjacent to the second column 13*c* as it retracts (e.g. by moving above or below the steps of the second column 13*c*). After the module 3 is returned to its first position 21, each drive mechanism 31 can be moved along the width W of its respective rack 13 via its moveable connection to the housing 9 to its extending position so that the leg of the drive mechanism 31 and the ratchet 33 are aligned with the first column 13*b* of steps for motion along that column of steps. Thereafter, the drive mechanisms 31 can be actuated again to extend the legs along the lengths L of the racks 13 to cause the ratchets 33 to move along the second columns 13*b* of steps to cause the module to continuously move linearly along a path of travel from its first position to its second position.

Figure 12:
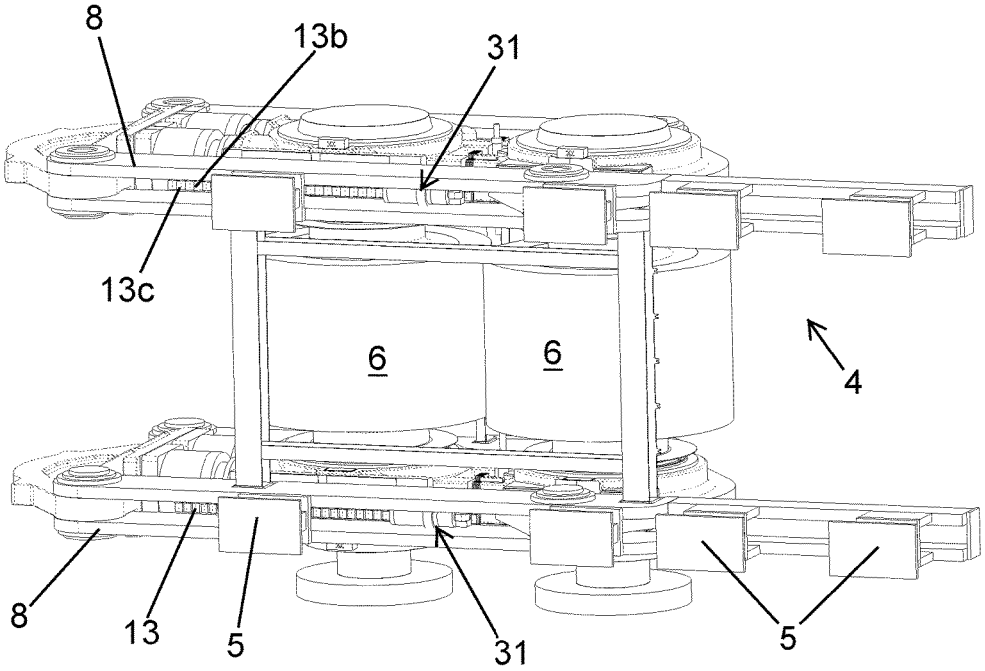
FIG. 12 is a bottom view of the cross sectional view of the fourth exemplary crushing body extraction mechanism illustrated in FIG. 11 to illustrate drive mechanisms configured for driving motion of rack components of the fourth exemplary crushing body extraction mechanism.

The extraction mechanism 11 can alternatively, or in combination, include a housing rack and ratchet arrangement. For example, as can be appreciated from FIGS. 10-12, each drive mechanism 31 can be connected to the frame 4 and also be attached to a respective ratchet 33 that includes at least one projection to engage the steps 13*a* of a respective rack 13 to drive motion of the rack 13 that is engaged with that ratchet 33.

Each drive mechanism 31 may be connected to the frame 4 via a moveable connection that includes a lateral moving mechanism that facilitates motion of the drive mechanism 31 along the width W of a respective rack 13 to which it is adjacent. The lateral moving mechanism of this connection can be any type of mechanism, such as a slider mechanism, gas cylinder, a hydraulic cylinder, a gear assembly mechanism that is powered to laterally move the drive mechanism or other type of moveable positioning mechanism. The moveable connection mechanism can also include a locking device for locking a position of the driving mechanism 31 in its extending position or in its retracting position.

Each rack 13 can be connected to the housing 9 for being positioned within the channel of a rail 8 of a frame for being positioned into contact with or engagement with a respective ratchet 33 to facilitate motion of the housing 9 and crushing bodies 6 of the module 3 from the first position 21 to the second position 22 and vice versa. In other embodiments, it is contemplated that the racks 13 can be positioned above a rail 8 or other structure of the frame 4 or may be positioned below a rail 8 or other component of a frame 4. For instance, each rack 13 can be connected to the housing 9 to be positioned for movement relative to the frame 4 where the rack 13 is position above a component of the frame 4, below the component of the frame 4, or within an aperture defined by some element of the frame (e.g. a slot within an elongated beam of the frame, a groove within a member of the frame, etc.). In yet other embodiments, the racks 13 can be positioned adjacent to a component of the frame via the racks' attachment to the housing 9 so that the racks 13 and housing 9 are moveable relative to the frame 4 for facilitating motion between the first and second positions 21 and 22. In yet other embodiments, it is contemplated that the connection of each rack 13 to the housing 9 for movement of the module 3 relative to the frame 4 can position that rack 13 adjacent to at least one component of the frame 4 (e.g. a rail, beam, or other type of member of the frame) to engage with a ratchet 33 in any of a number of other arrangements.

Motion of the ratchets 33 along steps of the racks 13 can be configured to cause the racks 13 to move toward the second position 22 or to move in an opposite linear direction toward the first position 21. For instance, during movement of the module 3 from the first position 21 to the second position 22, each drive mechanism 31 may be actuated to extend its leg to continuously linearly move the ratchet 33 connected thereto in a first longitudinal direction along the length L of the first column 13*b* of steps from a position adjacent the first end of the rack 13 to a position adjacent the second end of the rack. The leg of the drive mechanism 31 can move adjacent the length L of the rack adjacent to the first column 13*b* of steps as it continuously and linearly extends from the body of the drive mechanism (e.g. by moving above or below the steps of the first column 13*b*) to cause the ratchet to move along the steps of this column of steps from a position adjacent the first end of the rack to a position adjacent a second end of the rack that is opposite its first end. The extent to which the leg of the drive mechanism linearly extends from its retracted most position to its extended most position extends can define the distance of travel by which the module 3 moves from the first position 21 to the second position 22 and vice versa. The steps of the first column 13*b* of steps can be configured so that motion of the ratchet along the steps as the leg of extends causes the ratchet to contact each step to drive motion of the rack toward the second position 22 as the leg of the drive mechanism is extended to move the ratchet 33.

To return the module 3 to the first position 21, each drive mechanism 31 can be moved from its extending position to a retracting position by being moved via its moveable connection to the frame 4 along the width W of the rack 13 to be in alignment with the second column 13*c* of steps. This movement of each drive mechanism 31 along the width W of the rack can also cause the ratchet connected thereto to move along the width W to be in the second column 13*c* of steps. Thereafter, each drive mechanism 31 can be actuated to retract the leg to drive motion of the ratchet 33 along the second column 13*c* of steps in a second longitudinal direction along the length L of the rack 13 continuously from adjacent the second end of the rack to adjacent the first end of the rack. Each of the ratchets can engage the steps of the rack to which it is connected such that the motion of the ratchets causes the racks to move toward the first position 21 along a linear path defined by the racks 13 and rails 8 of the frame in which the racks are positioned via their attachment to the housing 9. Each retracting leg of each drive mechanisms 31 may move adjacent to the second column 13*c* of steps of a respective rack 13 as it retracts (e.g. by moving above or below the steps of the second column 13*c*). After the module 3 is returned to its first position 21, each drive mechanism 31 can be moved along the width W of its respective rack 13 to which it is aligned via its moveable connection to the frame 4 to its extending position so that the leg of the drive mechanism 31 and the ratchet 33 to which it is connected are aligned with the first column 13*b* of steps for motion of the ratchet 33 along that column of steps. Thereafter, the drive mechanisms 31 can be actuated again to extend the legs of the drive mechanisms to cause the ratchets 33 to move along the second columns 13*b* of steps to cause the module 3 to continuously move linearly along a path of travel from its first position 21 to its second position 22.

It is also contemplated that embodiments of the extraction mechanism 11 may be offered as an auxiliary tool for installing on pre-existing devices configured to comminute material. For example, an embodiment of the extraction mechanism may be retrofitted onto a housing and frame of a pre-existing device. The frame or housing may be structurally modified as needed during such retrofitting operations to facilitate installation of the extraction mechanism 11. A controller used to control operations of the extraction mechanism 11 can also be installed and communicatively connected to the drive mechanism of the extraction mechanism as well as other components of the extraction mechanism and/or other elements of the device during such retrofitting operations.

Embodiments of the extraction mechanism 11 can be configured to provide a safer environment for changing out crushing bodies of a device configured for comminution of material, such as rollers of a roller press. Embodiments of the extraction mechanism 11 are also able to provide a more efficient way to perform maintenance so that safety of personnel performing the maintenance work can be increased while downtime of the device can be reduced. This can provide a significant improvement in cost effectiveness to an operator of such a device.

For instance, it is contemplated that embodiments of the extraction mechanism can improve maintenance operations and reduce downtime of the device during such maintenance operations by at least 2-11%. Such an improvement can significantly improve the cost effectiveness of such devices while also improving the safety of personnel performing the maintenance work.

As will be understood by those of at least ordinary skill in the art, an embodiment of the device 1 and/or extraction mechanism 11 of the device 1 may have any number of shapes, sizes and/or configurations to meet a particular design parameter, design objective, or set of design criteria. For example, the shape and structure of the frame, the number of rails or other elongated member of the frame to which a rack is attached or to which a pinion or ratchet is connected can be any number that may be suitable to accommodate a weight and size of a module 3 to be moved and/or other design criteria. As yet another example, the number of crushing bodies within a module, the structure of the housing to which those crushing bodies are attached, the size and the size, shape, and weight of such structures can be any of a number of different options to meet a particular set of design criteria. As yet another example, an extraction mechanism may also include a first set of racks that are attached to a frame 4 and a second set of racks that are above or below the first set of racks that are attached to a housing of the module 3 or otherwise attached to crushing bodies 6 to facilitate motion of the crushing bodies 6. A first set of ratchets and/or pinions may be connected to one or more drive mechanisms and to the first set of racks and also be attached to the housing 9 or crushing bodies 6 for driving motion of the crushing bodies and housing from their first position to their second position and vice versa. A second set of ratchets and/or pinions may be connected to one or more drive mechanisms and to the second set of racks and also be attached to the frame 4 for driving motion of the crushing bodies and housing from their first position to their second position and vice versa. A controller may be connected to the drive mechanisms connected to the pinions and/or ratchets to control operation of the extraction mechanism (e.g. the speed at which the module 3 is moved from the first position to the second position and vice versa, when such motion occurs, etc.). In yet other embodiments, the extraction mechanism 11 may include only one rack 13 connected to one pinion 15 or ratchet 33 that is driven for continuous motion so that the module 3 is moved between the first and second positions 21 and 22.

While certain exemplary embodiments of the device 1 for comminution of material, an extraction mechanism 11 for use in such devices, and methods of making and using the same have been shown and described above, it is to be distinctly understood that the invention is not limited thereto, but may be otherwise variously embodied and practiced within the scope of the following claims.

What is claimed is:

1. A device configured to comminute material comprising:

a frame;

a module having a housing that is positionable within the frame and at least one crushing body connected to the housing;

an extraction mechanism, configured to linearly and continuously move the housing and the at least one crushing body relative to the frame from a first position located within the frame to a second position that is at least partially positioned out of the frame, the extraction mechanism also being configured to linearly move the housing and the at least one crushing body from the second position to the first position;

wherein the extraction mechanism comprises a rack connected to the frame and a ratchet that is moveable along the rack to cause movement of the housing and the at least one crushing body of the module from the first position to the second position;

wherein the extraction mechanism comprises a drive mechanism that is coupled to the ratchet to drive the ratchet along the rack and to allow travel of the module between the first position and the second position; the drive mechanism being connected to the housing; and wherein the drive mechanism comprises a cylinder that has a body and a leg that is connected to the body so that the leg is extendable and retractable; the leg being attached to the ratchet.

2. The device of claim 1, wherein the rack comprises a first column of steps and a second column of steps.

3. A method of comminuting material comprising:

operating the device of any of claims 1, to comminute material fed to that device via movement of the at least one crushing body; and operating the extraction mechanism of the device to move the at least one crushing body from first position to the second position for performance of maintenance.

* * * * *